United States Patent [19]

White

[11] 4,108,512

[45] Aug. 22, 1978

[54] CABINET MOUNTING UNIT FOR FREE ARM SEWING MACHINE

[76] Inventor: Eugene M. White, 1624 Franklin Ave., Fort Wayne, Ind. 46808

[21] Appl. No.: 808,099

[22] Filed: Jun. 20, 1977

[51] Int. Cl.[2] ..... A47B 81/00

[52] U.S. Cl. ..... 312/24; 312/27; 312/30; 112/217.1

[58] Field of Search ..... 312/24, 30, 208, 27, 312/22, 29, 23, 312, 306; 112/217.1

[56] References Cited

U.S. PATENT DOCUMENTS

| | | | |
|---|---|---|---|
| Re. 28,835 | 6/1976 | Roberts et al. | 312/22 |
| 1,057,809 | 4/1913 | Diehl et al. | 312/24 |
| 3,264,046 | 8/1966 | Preuss | 312/208 |
| 3,468,589 | 9/1969 | Maynard | 312/29 |
| 3,870,386 | 3/1975 | Shepherd | 312/30 |
| 3,918,780 | 11/1975 | Fritts | 312/30 |
| 3,986,755 | 10/1976 | Kohara | 312/27 |
| 3,993,008 | 11/1976 | Parsons Sr. | 112/217.1 |
| 4,005,918 | 1/1977 | Smith et al. | 312/27 |

*Primary Examiner*—Mervin Stein
*Assistant Examiner*—Victor N. Sakran
*Attorney, Agent, or Firm*—Albert L. Jeffers; John F. Hoffman

[57] ABSTRACT

A mechanism for mounting a free arm sewing machine in a work cabinet such that the machine is selectively supported in an upper work position wherein the free arm is positioned above the work surface of the cabinet, a lower work position wherein the free arm is substantially flush with the cabinet work surface, and a storage position wherein the machine is disposed completely beneath the work surface in a space efficient manner. The assembly comprises a base or platform to which the machine is mounted, a rear pivot arm rotatably secured to the platform and to the cabinet, a front pivot arm also pivotally secured to the platform and to the cabinet, and a pair of stops mounted to the cabinet and positioned within the vertical planes of rotation of the front pivot arms so that the front pivot arm and platform are supported against gravity in the lower use position. The stops include cam surfaces which enable the sides of the front pivot arm to ride over them when the machine is raised from the storage position. In order to lower the machine from the lower work position to the storage position, the machine and platform are tilted so as to urge the front and rear pivot arms to positions which are mutually coplanar thereby causing a binding action to occur which pulls the front pivot arms inwardly over the stops and enables the platform to drop to the storage position.

8 Claims, 14 Drawing Figures

CABINET MOUNTING UNIT FOR FREE ARM SEWING MACHINE

BACKGROUND OF THE INVENTION

The present invention relates to a unit for mounting a free arm sewing machine in a work cabinet and in particular to a unit whereby the machine is selectively supported in two work positions, one wherein the free arm is disposed above the cabinet work surface and the other wherein the free arm is flush with the work surface, and a storage position in which the entire sewing machine is contained within the cabinet beneath the work surface in a space efficient manner.

A free arm sewing machine is generally employed for sewing garments having a generally tubular configuration, such as trouser legs, sleeves, socks and the like. In use, the garment is slipped over the free arm, which is positioned above the bed or base of the machine.

A sewing machine of this type may also be used in the same fashion as a conventional flatbed machine wherein the needle plate is at the same level as the work surface of the cabinet. In order for the machine to assume this position, either the machine must be lowered or the work surface raised so that the upper surface of the free arm is substantially flush with the work surface of the cabinet. Since the free arm is narrower and shorter than the cabinet opening, wood inserts or the like are customarily positioned between it and the sides of the cabinet opening. This provides a continuous work surface flush with the needle plate and the machine may be utilized in the same manner as a conventional flatbed machine.

A conventional feature in sewing machine cabinets is a mechanism whereby the machine may be dropped to a lower storage position thereby enabling a hinged cover to be folded over the opening in the cabinet work surface. It is desirable for the machine to be rotated to a horizontal position when it is stored, as this normally results in greater economy of space.

Although mounting assemblies for supporting a free arm sewing machine in the storage position and two work positions described above are known they are often quite complex and difficult to operate. One prior art mounting unit disclosed in U.S. Pat. No. 4,005,918, comprises a pair of hinged members, one of which is mounted for pivotal movement within the cabinet. In the lower work position, the members are folded together parallel to and below the working surface of the cabinet. In the upper work position, wherein the free arm is completely exposed, one member is flush with the top of the cabinet while the other is angularly disposed between its pivotal mounting and the hinged connection with the upper member.

In U.S. Pat. No. Re. 28,835, the free arm machine cabinet includes a hingedly connected drop shelf and means for supporting the shelf parallel to and beneath the upper work surface of the cabinet. The drop shelf carries a mount for the machine and by means of linkage, permits raising and lowering of the machine to upper and lower work positions. This linkage includes a pivotally fulcrumed lever on the drop shelf having a work arm which underlies the machine mount so as to raise and lower the machine when the other arm of the lever is manually operated. The hinged connection for the shelf permits it to be dropped to its storage position.

One prior art free arm cabinet presently on the market comprises a first pair of pivot arms pivotally secured to the back of the cabinet and the machine mounting bracket, and a second pair of pivot arms positioned respectively above the first arms and pivotally secured to the back of the cabinet and the mounting bracket. The machine is supported on the pivot arms in two use positions and a storage position. In the storage position, however, the machine is inclined upwardly from the horizontal so that it occupies approximately 15 in. of depth as opposed to the present invention wherein the required storage depth is no greater than the width of the supporting platform, e.g. approximately 7 in.

Other examples of prior art mounting arrangements for free arm sewing machines include U.S. Pat. Nos. 3,993,008 and 3,468,589, wherein the machine is mounted for rectilinear movement on vertical tracks. In U.S. Pat. No. 3,918,780, a complicated gear train is utilized to move the machine between the various positions.

The present invention overcomes the disadvantages of the prior art by providing an extremely simple arrangement whereby the free arm sewing machine may be supported in upper and lower use positions wherein the upper surface of the free arm is disposed respectively above and flush with the work surface of the cabinet, and in a storage position within the cabinet wherein the machine is rotated to a horizontal position just beneath the cabinet work surface.

This is accomplished by means of a pair of pivot arms which are pivotally secured to the cabinet and hingedly connected to the machine mounting platform. In the storage position, the mounting platform is rotated to a vertical position such that the machine lies horizontally within the cabinet. The base of the machine is forced upwardly against the top of the storage compartment due to the fact that the center of gravity is forward of the cabinet mounting points for the pivot arms. This is also advantageous from the standpoint that part of the machine is dropping during the initial movement out of the storage position thereby partially counterbalancing the weight of the machine. In the lower use position, the platform is rotated to a horizontal position parallel to and beneath the work surface of the cabinet and the segments of the front pivot arms which extend between the cabinet pivots and the platform hinges are supported on a stop which is mounted to the opposite side walls of the cabinet. In the upper use position, the mounting platform is supported on the conventional cabinet flip board and the rear pivot arm which urges the platform forwardly against the flip board.

In order to clear the stops when dropping the machine from the lower use position to the storage position, the machine and platform are tilted forwardly thereby urging the pivot arms to positions which are mutually coplanar. This causes the arms to bind and pulls the side portions of the forward arm inwardly over the stops and permits the entire assembly to drop downwardly past the stops. In order to enable the sides of the forward arm to be pulled inwardly, the ends thereof are mounted for axial sliding movement.

Specifically, the present invention contemplates a cabinet mounting unit for free arm sewing machines comprising: a platform or other means for attaching the machine, a first pivot arm connected to the cabinet and to the platform, a second pivot arm piovtally connected to the cabinet and platform and having a plane of rotation, first means for supporting the platform and pivot arms whereby the platform occupies an upper work position parallel to the cabinet work surface, second means for supporting the platform and pivot arms whereby the platform occupies a lower work position parallel to the cabinet work surface and below the aforesaid upper position, the second means including a stop mounted to the cabinet and being within the second arm plane of rotation, the stop being engaged by the second pivot arms and supporting it and the platform against gravity, and third means for pulling the second pivot arm inwardly out of plane of rotation so that the second pivot arm clears the stop and is free to drop downwardly past the stop together with the platform to a storage position.

It is an object of the present invention to provide a cabinet mounting unit for free arm sewing machines wherein the machine is selectively supported in an upper use position with the free arm disposed above the cabinet work surface, in a lower use position werein the top surface of the free arm is flush with the cabinet surface, and a storage position wherein the entire machine is disposed beneath the cabinet surface and in a horizontal position.

Another object of the present invention is to provide a cabinet mounting unit for free arm sewing machines which is of simple and efficient construction thereby minimixing manufacturing costs and increasing reliability.

A further object of the present invention is to provide a cabinet mounting unit for free arm sewing machines requiring no more space for storage than conventional flatbed machines.

A still further object of the present invention is to provide a cabinet mounting unit for free arm sewing machines wherein the machine is capable of being shifted between storage and upper and lower use positions quickly and with a minimum of effort.

Yet another object of the present invention is to provide a free arm mounting unit which can be easily installed in existing flatbed sewing machine cabinets.

These and other objects and features of the invention will become more apparent from the following description of a preferred embodiment taken together with the accompanying drawings.

DESCRIPTION OF THE PREFERRED EMBODIMENT

Figure 1:
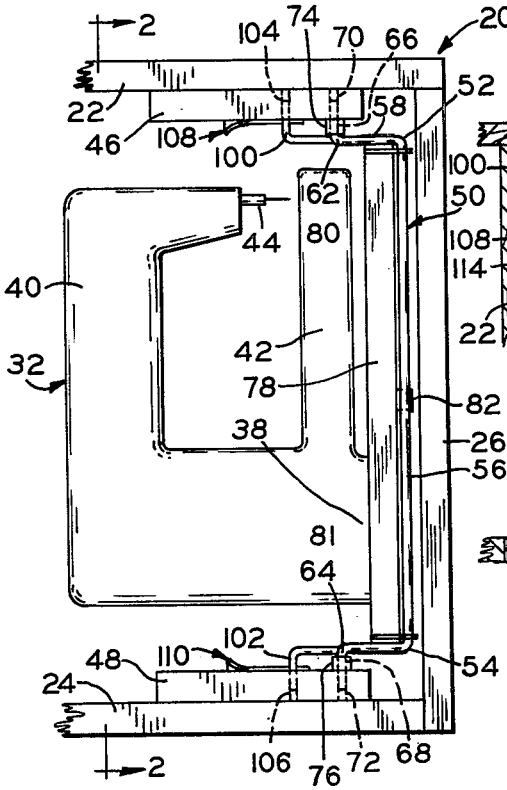
FIG. 1 is a fragmentary top plan and partially sectioned view of a sewing machine cabinet constructed in accordance with the present invention having a free arm sewing machine mounted therein which is in the storage position.

Referring now to the drawings, the mounting unit of the present invention is shown installed in a conventional sewing machine work cabinet 20 having side walls 22 and 24, a rear wall 26 and a front wall 25. Characteristically, cabinet 20 is constructed of wood and has a cover (not shown) hingedly secured to its top 28 and adapted to be folded thereover. An opening 30 in cabinet top 28 provides access for the sewing machine 32 and enables it to be shifted between its storage position and upper and lower use positions. A conventional flip board 34 is hingedly connected to top 28 and has a step 36 therein for the purpose of supporting the machine 32 in the upper use position shown in FIG. 12.

The sewing machine 32 to which the present invention is adapted is a free arm machine having base 38, arm 40 and free arm 42. As illustrated, free arm 42 is integrally connected to the machine 32 at one end and extends above the level of base 38 toward needle assembly 44 parallel with arm 40. Free arm machine 32 is completely conventional and forms no part of the present invention.

A pair of mounting 46 and 48 are rigidly secured to side walls 22 and 24 may also be constructed of wood. If desired, blocks 46 and 48 may be eliminated and the assembly described hereinafter mounted directly to side walls 22 and 24. A rear pivot arm 50, which may consist of a bent metal rod, includes two bends 52 and 54 which may be approximately 90° at opposite ends of center segment 56, side segments 58 and 60, two bends 62 and 64 which are in opposite directions from bends, 52 and 54, and end segments 66 and 68. End segments 66 and 68 are rotatably received within holes 70 and 72 in blocks 46 and 48. Spacers 74 and 76 may be provided if desired.

A flat mounting platform 78, to which sewing machine 32 is fastened, is pivotally connected to the center segment 56 of pivot arm 50 by means of brackets 80 and 81. Obviously, platform 78 will rotate about an axis collinear with center segment 56 and pivot arm 50 will rotate about an axis collinear with end segments 66 and 68. Although pivot arm 50 is described as being a single metal rod bent to the described shape, it could comprise two separate pivot arms such as segments 58 and 60 each of which are rotatably connected to platform 78 and to mounting blocks 46 and 48. Platform 78 is not limited to the particular structure shown and could comprise an open frame or could even be the base 38 of machine 32 itself.

Also pivotally connected to mounting platform 78 by means of hinge 82 is a front pivot arm 84. Arm 84 consists of a single metal rod possessing a moderate degree of resiliency or spring having a center segment 86, two bends 88 and 90 at either end of center segment 86, a pair of side sections 92 and 94, another pair of bends 96 and 98, and end segments 100 and 102 pivotally and slideably received in holes 104 and 106 in mounting blocks 46 and 48. Front pivot arm 84 is therefore rotatable about an axis collinear with end segments 104 and 106 and platform 78 is rotatable about an axis collinear with front arm center segment 86. This double pivot arm arrangement affords platform 78 substantial freedom of movement both rotational and translational. As will be seen at a later point, this freedom of movement is important in that it enables rotation to and from the storage position and translation between the upper and lower use positions.

Figure 2:
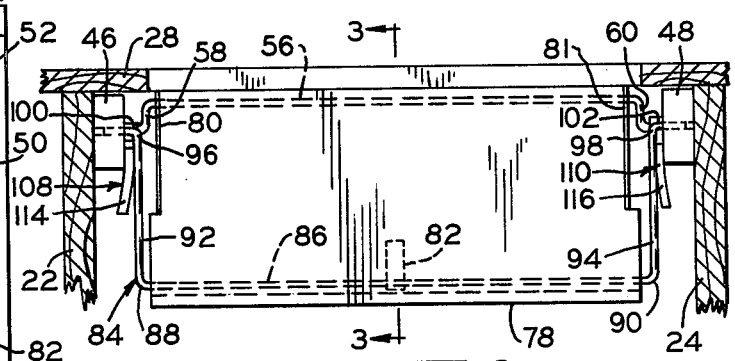
FIG. 2 is a sectional view of FIG. 1 taken along line 2—2 and viewed in the direction of the arrows, wherein the sewing machine has been removed.

A pair of stops 108 and 110 are secured to mounting blocks 46 and 48, respectively, by means of screws 112. In the form illustrated, stops 108 and 110 comprise a L-shaped bracket wherein the depending legs 114 and 116 are bent inward from mounting blocks 46 and 48 so as to provide support for the side segments 92 and 94 of front pivot arm 84 when platform 78 is in the lower work position shown in FIGS. 7, 8 and 9. Legs 114 and 116 are bent slightly outward as shown in FIGS. 2 and 8 to as to provide a cam surface which enables the side segments 92 and 94 to ride over stops 108 and 110 as the machine 32 is raised from the storage position to the lower work position. Obviously, the particular form of stops 108 and 110 is not restricted to that shown. The important aspects thereof are the provision of upper surfaces which will support side segments 92 and 94 of pivot arm 86 against gravity and inclined or curved surfaces which will enable segments 92 and 94 to ride over the stops when the assembly is raised. Even the cam surfaces are not essential since the assembly could be raised past the stops 108 and 110 by effecting the binding action between pivot arms 50 and 84 in a manner which will be described below.

OPERATION

Figure 3:
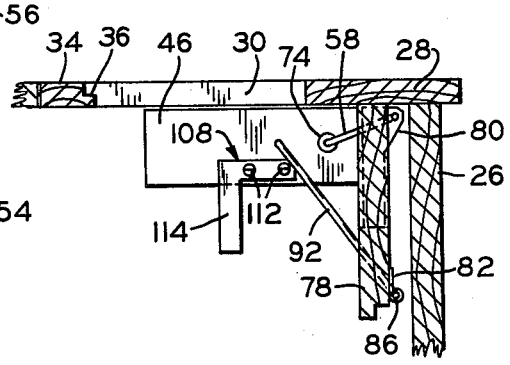
FIG. 3 is a fragmentary sectional view of FIG. 2 taken along line 3—3 and viewed in the direction of the arrows.

Referring now to FIGS. 1, 2 and 3, the machine 32 is shown in the storage position. In this position, sewing machine 32 is horizontal and is suspended from mounting blocks 46 and 48 by pivot arms 50 and 86. As will be appreciated, this is the position which results in the most efficient and economical utilization of storage space because the machine lies parallel to the cabinet work surface 28. In free arm cabinets wherein the machine is supported in a vertical or oblique position in storage, utility storage within the cabinet is sacrificed.

Figure 4:
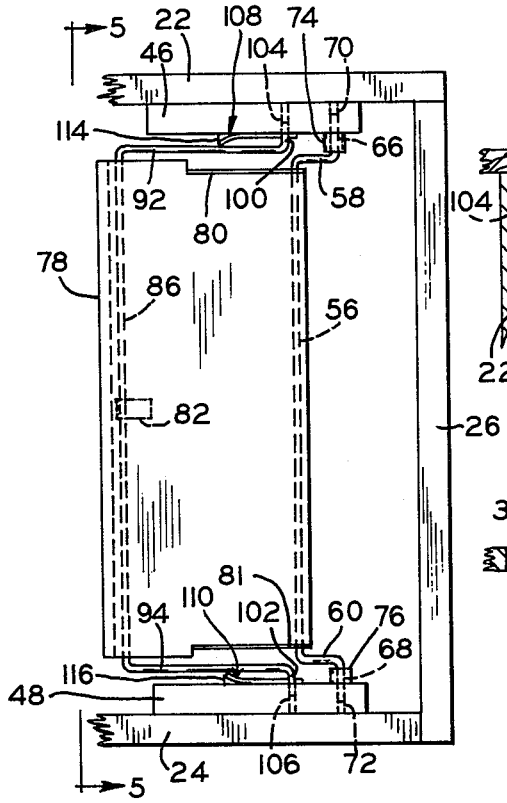
FIG. 4 is a fragmentary top plan view partially in section of the cabinet with the sewing machine removed wherein the supporting platform is in a transition position between the storage position of FIG. 1 and the lower use position of FIGS. 7, 8 and 9.
Figure 5:
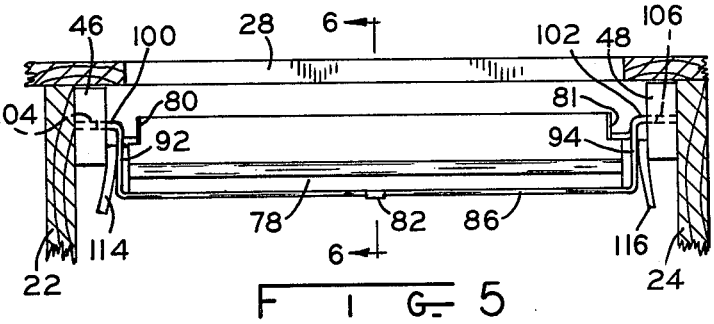
FIG. 5 is a front elevational view, partially in section, taken along line 5—5 of FIG. 4 and viewed in the direction of the arrows.
Figure 6:
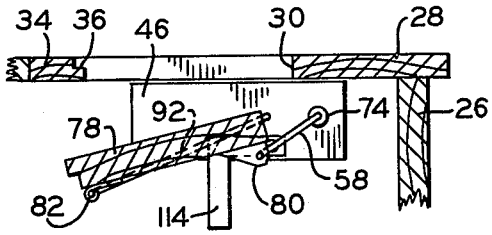
FIG. 6 is a fragmentary sectional view of FIG. 5 taken along line 6—6 and viewed in the direction of the arrows.
Figure 7:
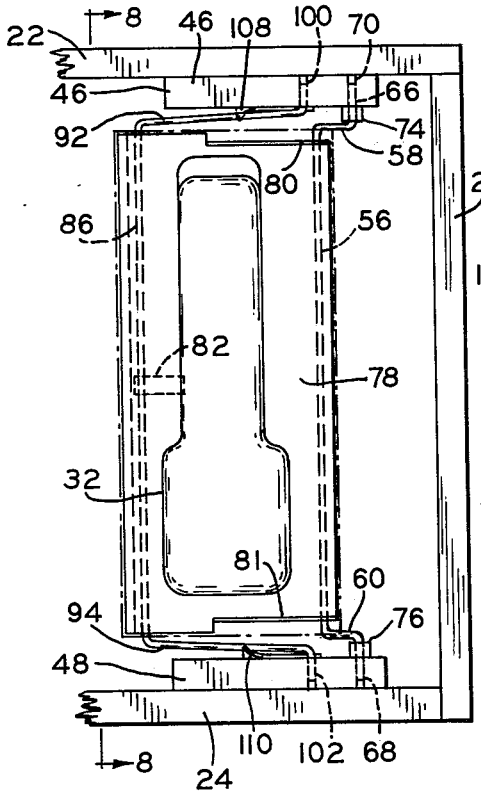
FIG. 7 is a fragmentary top plan view of the cabinet partially in section wherein the supporting platform and machine are in the lower use position.
Figure 8:
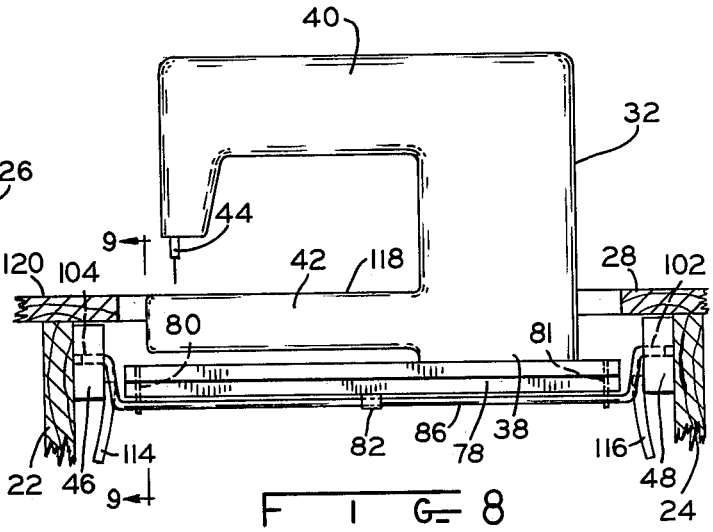
FIG. 8 is a front elevational view partially in section taken along line 8—8 of FIG. 7 and viewed in the direction of the arrows.
Figure 9:
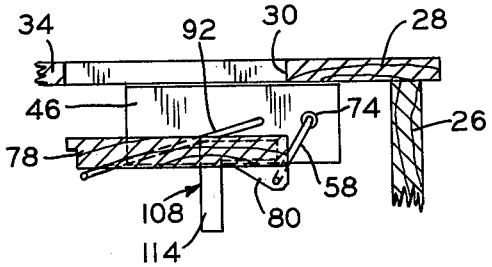
FIG. 9 is a fragmentary sectional view of FIG. 8 taken along line 9—9 and viewed in the direction of the arrows.
Figure 10:
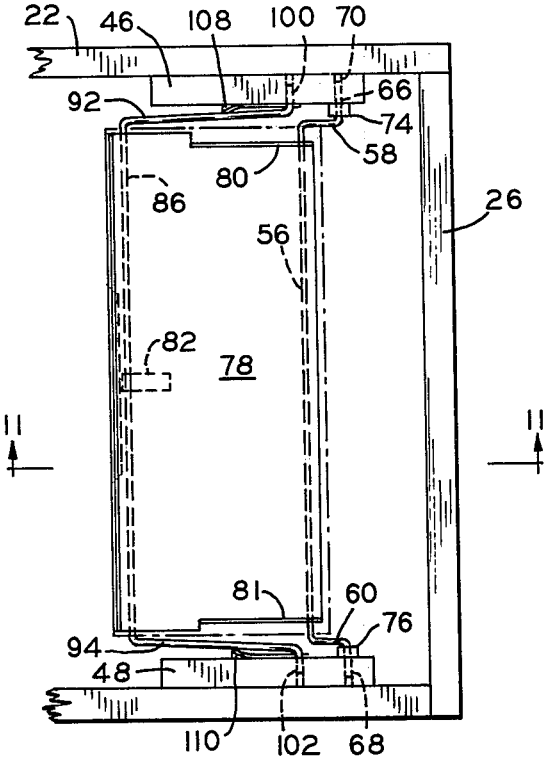
FIG. 10 is a fragmentary top plan view partially in section of the cabinet wherein the sewing machine and its supporting platform are in a transition position between the lower use position of FIGS. 7, 8 and 9 and the upper use position of FIG. 12.

With reference now to FIGS. 4, 5 and 6, the machine 32 is raised to the lower work position of FIGS. 7, 8 and 9 by rotating it together with platform 78 about the axis of end segments 66, 68 and 100, 102. As the side segments 92 and 94 of front pivot arm 84 encounter stops 108 and 110, the inclined surfaces of depending leg portions 114 and 116 will push them inwardly and partially pull end segments 100 and 102 out of their respective holes 104 and 106. When side segments 92 and 94 have cleared stops 108 and 110, they will snap outwardly due to the resiliency of pivot arm 84 and the assembly will occupy the position shown in FIGS. 7, 8 and 9.

As best shown in FIG. 8, side segments 92 and 94 of front arm 86 will rest on stops 108 and 110. The upper surface 118 of free arm 42 is flush with the upper surface 120 of cabinet top 28. As is customary practice, a wood insert (not shown) may be inserted between the side of opening 30 and free arm 42 so as to provide a continuous work surface.

Figure 11:
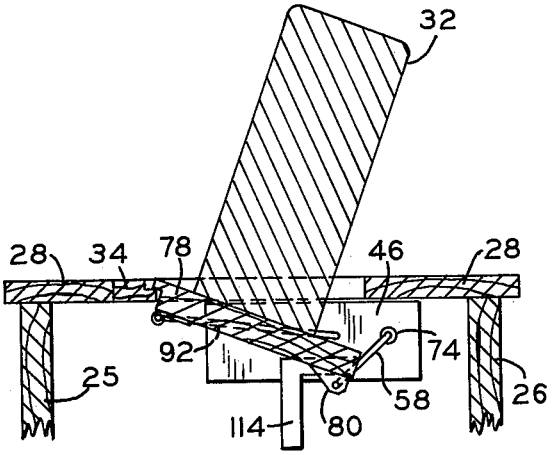
FIG. 11 is a sectional view of FIG. 10 taken along line 11—11 and viewed in the direction of the arrows.
Figure 12:
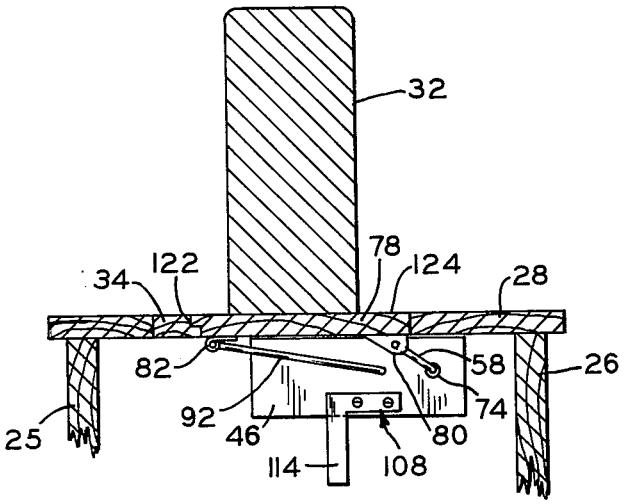
FIG. 12 is a side sectional view of the cabinet wherein the sewing machine and supporting platform are in the upper use position.

The machine 32 is raised to the upper work position wherein the free arm is disposed above the cabinet work surface 120 by tilting the machine 32 rearwards as shown in FIG. 11, resting platform 78 on the edge of flip board 34 and then pulling the machine upward and forward thereby causing pivot arms 50 and 86 to cross and then assume the positions shown in FIG. 12.

In the upper work position (FIG. 12), the rear pivot arm 50 exerts an upward and forward supporting force on platform 78. The flip board 112 functions as a support against gravity for the front edge of platform 78 and also as a forward stop for platform 78 which is urged forwardly by arm 50. This prevents the rear arm 50 from rotating downwardly so that it supports the rear of platform 78 against gravity.

Direct vertical movement in a downward direction will not cause machine 32 to drop downwardly from the position of FIG. 12. To lower the machine 32, it is tilted rearwardly until the forward edge 122 will drop off flip board 34. Side segments 92 and 94 of forward arm 84 will then engage stops 108 and 110 (FIGS. 7, 8 and 9).

Figure 13:
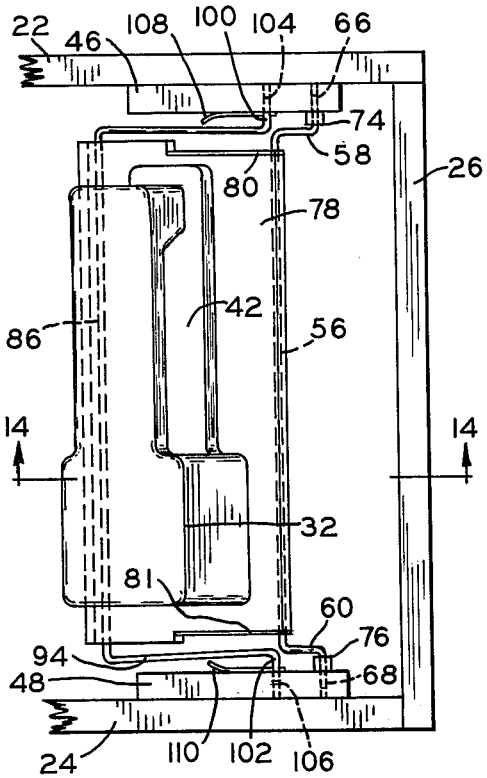
FIG. 13 is a fragmentary top plan view partially in section of the cabinet wherein the sewing machine and supporting platform are in a transition position between the lower use position of FIGS. 7, 8 and 9 and the storage position of FIGS. 1, 2 and 3.
Figure 14:
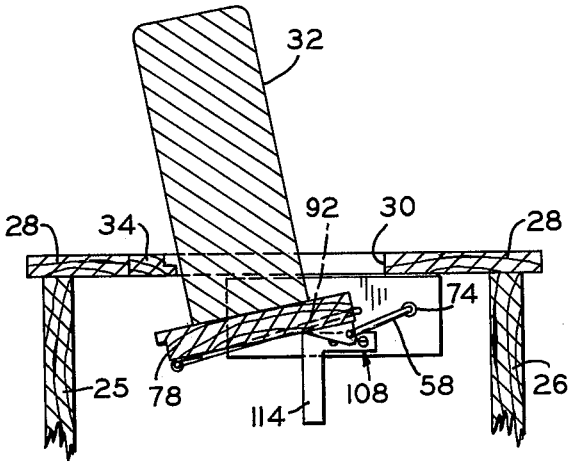
FIG. 14 is a sectional view of FIG. 13 taken along line 14—14 and viewed in the direction of the arrows.

For the machine 32 to be lowered to the storage position of FIGS. 1, 2 and 3 from the lower work position of FIGS. 7, 8 and 9, the machine 32 is tilted forwardly as shown in FIGS. 13 and 14 so that arms 50 and 84 are urged toward mutually coplanar positions. When the arms 50 and 84 are coplanar, if the distance between the cabinet mounting pivots for the arms plus the length of segments 92 and 94 of front arms 84 is less than the distance between segments 56 and 86 plus the length of segments 58 and 60 of rear arm 50, then the arms 50 and 84 will bind and the more susceptible arm will be pulled inwardly (FIG. 13). In this case, the front arm 84 is more susceptible to bending due to the center hinge 82 as opposed to the double hinge for rear arm 50, and also due to the longer lengths of segments 92 and 94. Other means, such as making one arm out of more flexible material, could also be employed to influence relative susceptibility to bending.

Thus, as the forward arms are forced forwardly beyond their normal radius, side segments 92 and 94 are pulled inwardly away from mounting blocks 46 and 48 until they clear stops 108 and 110. The machine 32 and platform 78 is then dropped downwardly past stops 108 and 110 and rotated to the storage position shown in FIGS. 1, 2 and 3. By this means, the machine is shifted from the lower work position without any motion in addition to the pivoting of the machine into storage.

As is apparent from the above description, the machine 32 may be moved from one position to another by merely exerting force on the machine itself and, with the exception of raising or lowering the flip board 34, no other levers, latches, or the like need be operated. Thus, the supporting of a free arm sewing machine is any of the desired positions is accomplished by means of a relatively uncomplicated mechanical structure, as distinguished from the prior art wherein generally the mechanisms are more complex.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the appended claims.

What is claimed is:

1. A cabinet mounting unit for free arm sewing machines comprising:

a frame having a pair of opposite side members, a rear pivot arm, first pivot means pivotally connecting said rear arm to one of said side members for rotation about a first axis, a front pivot arm, second pivot means pivotally connecting said front arm to one of said side members for rotation about a second axis parallel to and displaced from said first axis, a sewing machine mounting platform, third pivot means pivotally connecting said platform to said rear arm for rotation about axes parallel to and displaced from said first and second axes, fourth pivot means pivotally connecting said platform to said front arm for rotation about axes parallel to and displaced from said first, second and third axes, stop means stationarily connected to and projecting inwardly from said one of said side members so as to be contacted by said front arm at a particular point in its rotation about said second axis thereby supporting said platform at a selected vertical level, and means associated with said front and rear arms whereby when said arms are urged toward respective positions which are coplanar, said arms undergo a binding action whereby said front arm is pulled inwardly away from said one of said side members so as to clear said stop means and permit said platform to be lowered below said selected vertical level.

2. The mounting unit of claim 1 wherein:

said front and rear arms comprise respectively first and second metal rods, each of said rods comprising: a first segment which extends from one side of said platform to the other and is pivotally attached thereto, first and second bends in said rod adjacent said platform sides, second and third segments having one of their ends adjacent said first and second bends, respectively, third and fourth bends in said rod adjacent the other ends of said second and third segments, fourth and fifth segments adjacent said third and fourth bends, respectively, said fourth and fifth segments extending away from said platform and being collinear and substantially parallel to said first segment, said fourth and fifth segments of said second rod are pivotally received respectively in said opposite side members of said frame, said first rod is spaced from said second rod, said first rod fourth and fifth segments are pivotally received respectively in said opposite frame sides and are slideable therein along their mutual axis of collinearity.

3. The mounting unit of claim 2 including a second stop on the other of said frame sides and wherein said means associated with said front and rear arms includes means whereby a binding action occurs between said front and rear pivot arms as said arms are urged toward mutually coplanar positions and the binding action causes said front arm fourth and fifth segments to be pulled inwardly toward said platform until said second and third segments of said front arm clear said stops and are free to rotate past said stops.

4. A cabinet mounting unit for free arm sewing machines comprising:

a frame having a pair of opposite side members, a sewing machine support platform, a first pivot arm pivotally connected to one of said side members about a first pivot for rotation about a first axis, first means pivotally connecting said platform to said first pivot arm about a second pivot for rotation about a second axis parallel to said first axis, a second pivot arm pivotally connected to one of said members about a third pivot for rotation about a third axis parallel to said first and second axes, second means pivotally connecting said platform to said second pivot arm about a fourth pivot for rotation about a fourth axis parallel to said first, second and third axes, said first and second pivots being spatially related pivots with respect to each other, said third and fourth pivots being spatially related pivots with respect to each other, said second and fourth pivots being spatially related pivots with respect to each other, and said first and third pivots being spatially related pivots with respect to each other, said mounting unit having an upper use position, a lower use position in which said platform is lower than it is when said mounting unit is in the upper use position, and a storage position, said first and second means and said pivot arms being arranged such that said second and fourth pivots and one of said first and third pivots become substantially coplanar when said platform is moved between said lower use position and one of said upper use position and said storage position, and means for avoiding inoperative binding of said pivot arms when said second and fourth pivots and one of said first and third pivots are coplanar comprising means whereby one of said pivots and its respective axis is translatable relative to one of its said spatially related pivots.

5. The cabinet mounting unit of claim 4 including:

a third pivot arm pivotally connected to the other of said side members about a fifth pivot coaxial with said first pivot, third means pivotally connecting said platform to said third arm for rotation about a sixth pivot coaxial with said second pivot, a fourth pivot arm pivotally connected to said side member about a seventh pivot coaxial with said third pivot, fourth means pivotally connecting said platform to said fourth pivot arm for rotation about an eighth pivot coaxial with said fourth pivot, said fifth and sixth pivots being spatially related pivots with respect to each other, said seventh and eighth pivots being spatially related pivots with respect to each other, said sixth and eighth pivots being spatially related pivots with respect to each other and said fifth and seventh pivots being spatially related pivots with respect to each other, said third and fourth means and said third and fourth pivot arms being arranged such that said sixth and eighth pivots and one of said fifth and seventh pivots become coplanar when said platform is moved between said lower use position and one of said upper use position and said storage position, and means for avoiding inoperative binding of said third and fourth pivot arms when said pivots become coplanar comprising means whereby one of said fifth, sixth, seventh and eighth pivots is translatable relative to one of its spatially related pivots.

6. The cabinet mounting unit of claim 4 wherein said means for avoiding inoperative binding comprises means whereby one of said first and third pivots is axially movable relative to said one side member.

7. The cabinet mounting unit of claim 4 wherein said means for avoiding inoperative binding comprises a flexible portion in one of said arms.

8. A cabinet mounting unit for free arm sewing machines comprising:

a frame having a pair of opposite side members, a sewing machine support platform, a first pivot arm pivotally connected to one of said side members about a first pivot for rotation about a fist axis, first means pivotally connecting said platform to said first pivot arm about a second pivot for rotation about a second axis parallel to said first axis, a second pivot arm pivotally connected to one of said members about a third pivot for rotation about a third axis parallel to said first and second axes, second means pivotally connecting said platform to said second pivot arm about a fourth pivot for rotation about a fourth axis parallel to said first, second and third axes, said first and second pivots being spatially related pivots with respect to each other, said third and fourth pivots being spatially related pivots with respect to each other, said second and fourth pivots being spatially related pivots with respect to each other, and said first and third pivots being spatially related pivots with respect to each other, said mounting unit having an upper use position, a lower use position in which said platform is lower than it is when said mounting unit is in the upper use position, and a storage position, stop means for engaging the mechanism comprising said pivot arms and platform and supporting said mechanism in the lower use position, said first and second means and said pivot arms being arranged such that said second and fourth pivots and one of said first and third pivots become substantially coplanar when said mounting unit is moved between said lower use position and one of said upper use position and said storage position, means for avoiding inoperative binding of said pivot arms when said second and fourth pivots and one of said first and third pivots are coplanar comprising means whereby one of said pivots and its respective axis is translatable relative to one of its said spatially related pivots, said means for avoiding inoperative binding causing said mechanism to disengage from said stop means and permit said mechanism to drop past said stop means and including means whereby a binding action occurs between the first and second arms as said arms urged towards mutually coplanar positions, said binding action causing one of said arms to be pulled away from said stop means in a generally horizontal direction.

* * * * *

UNITED STATES PATENT AND TRADEMARK OFFICE

CERTIFICATE OF CORRECTION

PATENT NO. : 4,108,512

DATED : August 22, 1978

INVENTOR(S) : Eugene M. White

It is certified that error appears in the above-identified patent and that said Letters Patent are hereby corrected as shown below:

Column 2, line 43, change "arms" to -- arm --.

Column 3, line 17, change "werein" to -- wherein --.

Column 4, line 51, insert -- blocks -- between "mounting" and "46".

Column 5, line 2, change "described" to -- desired --.

Column 5, line 36, change "to" to -- so --.

Column 6, line 11, change "side" to -- sides --.

Column 6, line 23, change "112" to -- 122 --.

Column 6, line 67, insert -- arms, -- between "levers," and "latches,".

Claim 3, Column 8, lines 6 through 15, should read as follows:

-- 3. The mounting unit of Claim 2 including a second stop on the other of said frame sides and wherein said means associated with said front and rear arms includes means whereby said binding action causes said front arm fourth and fifth segments to be pulled inwardly toward said platform until said second and third segments of said front arm clear

UNITED STATES PATENT AND TRADEMARK OFFICE

CERTIFICATE OF CORRECTION

PATENT NO. : 4,108,512

DATED : August 22, 1978

INVENTOR(S) : Eugene M. White

It is certified that error appears in the above-identified patent and that said Letters Patent are hereby corrected as shown below:

said stops and are free to rotate past said stops. --

Claim 8, Column 9, line 34, change "fist" to -- first --.

Signed and Sealed this

*Third* Day of *July 1979*

[SEAL]

*Attest:*

*Attesting Officer*

LUTRELLE F. PARKER

*Acting Commissioner of Patents and Trademarks*